US010881171B2

(12) United States Patent
Provencher

(10) Patent No.: US 10,881,171 B2
(45) Date of Patent: Jan. 5, 2021

(54) MAGNETIC CLASP SYSTEM

(71) Applicant: Boston Inventions, LLC, Waltham, MA (US)

(72) Inventor: Samuel David Provencher, Waltham, MA (US)

(73) Assignee: Boston Inventions, LLC, Waltham, MA (US)

( * ) Notice: Subject to any disclaimer, the term of this patent is extended or adjusted under 35 U.S.C. 154(b) by 0 days.

(21) Appl. No.: 16/410,466

(22) Filed: May 13, 2019

(65) Prior Publication Data

US 2019/0343238 A1 Nov. 14, 2019

Related U.S. Application Data

(60) Provisional application No. 62/669,997, filed on May 11, 2018.

(51) Int. Cl.
*A44B 11/12* (2006.01)

(52) U.S. Cl.
CPC ..... *A44B 11/12* (2013.01); *A44D 2203/00* (2013.01)

(58) Field of Classification Search
CPC ..... A44B 11/12; A44B 11/04; A44D 2203/00
See application file for complete search history.

(56) References Cited

U.S. PATENT DOCUMENTS

| | | | | |
|---|---|---|---|---|
| 6,698,070 | B2 * | 3/2004 | Chen | A44B 11/006 24/185 |
| 9,907,367 | B2 * | 3/2018 | Paik | A41F 1/002 |
| 9,936,772 | B2 * | 4/2018 | Paik | A45F 3/047 |
| 10,143,270 | B2 * | 12/2018 | Fiedler | A44B 11/2588 |
| 10,617,179 | B2 * | 4/2020 | Fiedler | A44B 11/12 |
| 2017/0127764 | A1 * | 5/2017 | Fiedler | A44B 11/12 |

* cited by examiner

*Primary Examiner* — Robert Sandy
(74) *Attorney, Agent, or Firm* — Ascentage Patent Law, LLC; Travis Lee Johnson

(57) ABSTRACT

A magnetic clasp system, having a clasping assembly, which includes a base and a hinged locking component rotationally affixed to the base wherein the hinged locking component and the base defining a tortuous path therebetween configured to receive a strap, and wherein the base includes a magnetically responsive material. The magnetic clasp system also including a mounting assembly, the mounting assembly including a magnetically responsive material configured to draw the clasping assembly and the mounting assembly together when within a magnetic field thereof. The magnetic clasp system also including a stop configured to limit lateral translation between the clasping assembly and the mounting assembly when engaged.

8 Claims, 6 Drawing Sheets

MAGNETIC CLASP SYSTEM

PRIORITY

This application claims priority to U.S. provisional application No. 62/669,997, which was filed on May 11, 2018, and is hereby incorporated by reference in its entirety.

COPYRIGHT STATEMENT

A portion of the disclosure of this patent application document contains material that is subject to copyright protection including the drawings. The copyright owner has no objection to the facsimile reproduction by anyone of the patent document or the patent disclosure as it appears in the Patent and Trademark Office file or records, but otherwise reserves all copyright rights whatsoever.

BACKGROUND OF THE INVENTION

1. Field of the Invention

The disclosure relates to an adjustable magnetic clasp system for combining two ends of a strap or belt.

2. Description of the Prior Art

Present systems for closing a strap often involve the use of buttons, hook and loop type fasteners, snaps, and other mechanical methods for fastening two independent components together. One of the objectives of the present invention is to provide designs that are elegant, reliable and user-friendly.

DETAILED DESCRIPTION

The present embodiments have been invented to provide an elegant clasp system that is reliable and user-friendly, while also being aesthetically desirable.

Figure 1:
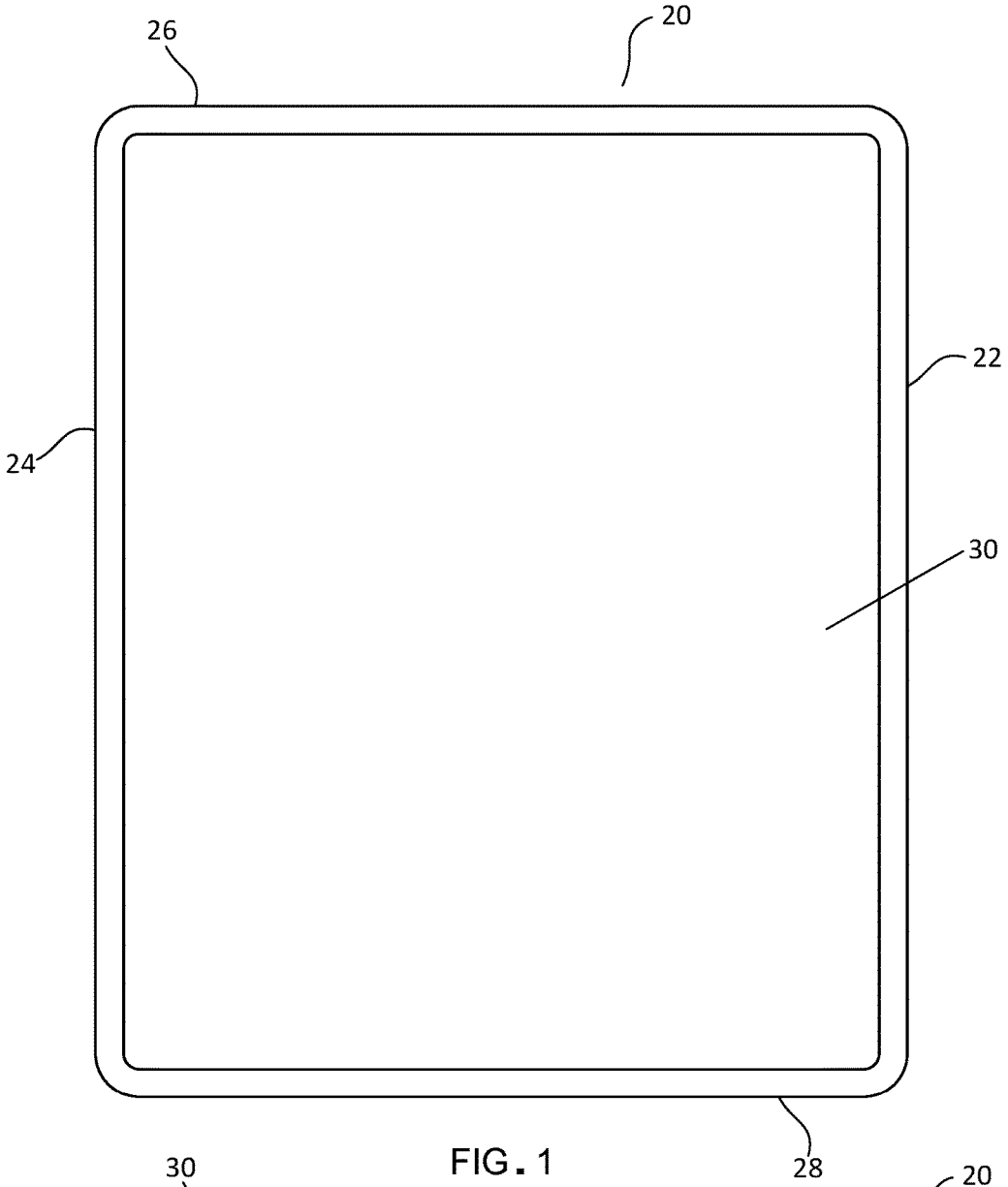
FIGS. 1-5 illustrate top, right, left, front and isometric views of clasp component for a magnetic clasp system in accordance with various aspects of the present invention.
Figure 2:
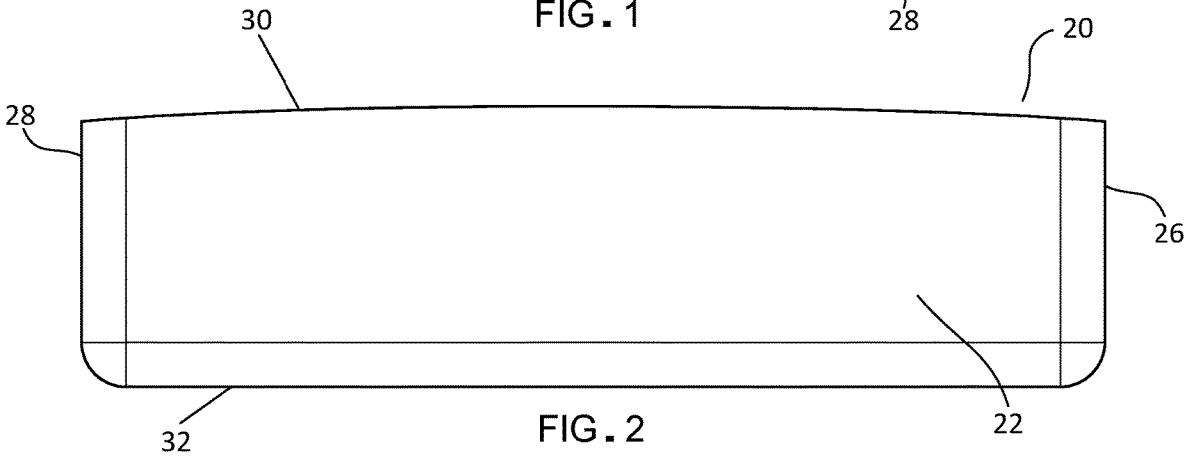
Figure 3:
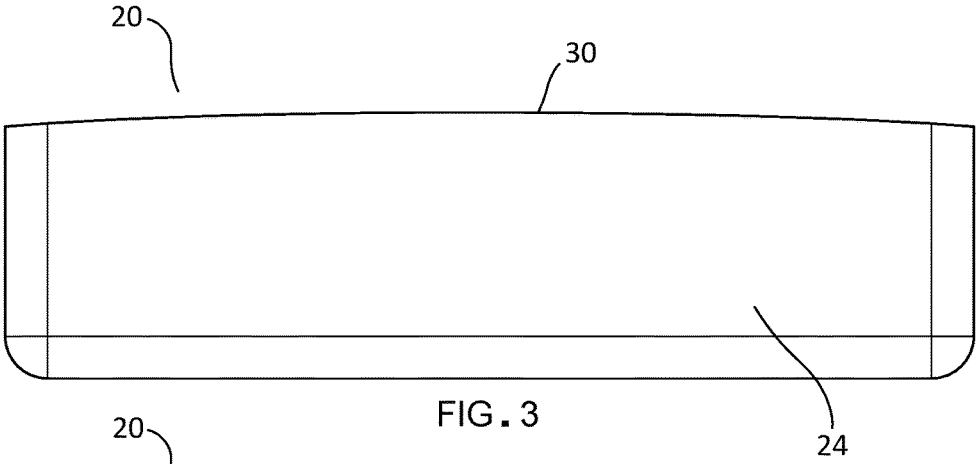
Figure 4:
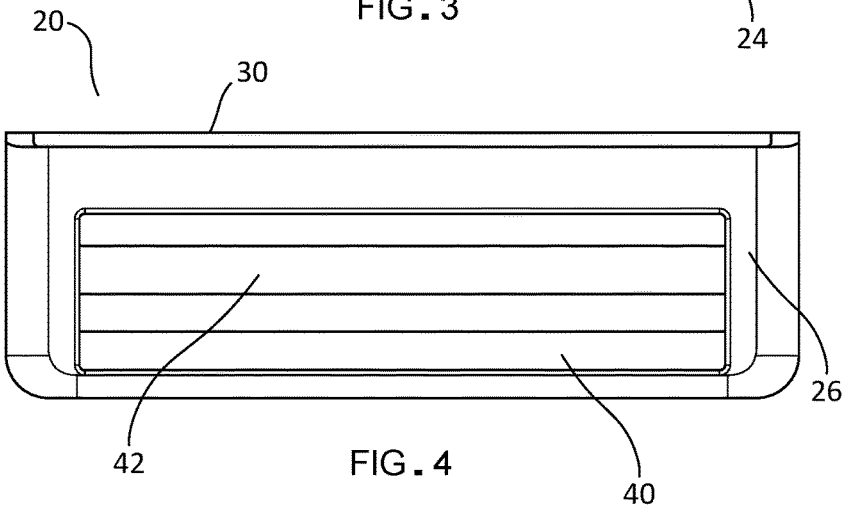
Figure 5:
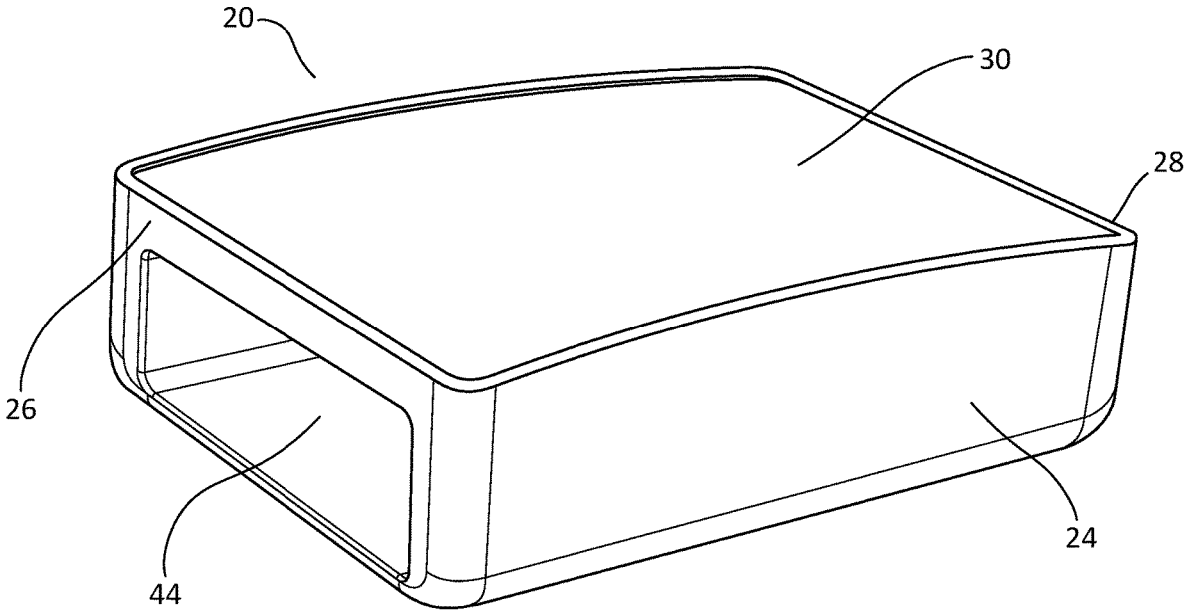

FIGS. 1-10 provided herein disclose one embodiment of a magnetic clasp system 10A. In particular, FIGS. 1-5 illustrate various views of the clasp assembly 20, having sidewalls 22 and 24, front surface 26, back surface 28, top surface 30, bottom portion 32 and channel 44. FIG. 1 illustrates a top view of the clasp assembly 20, while FIGS. 2-3 each show side views of clasp assembly 20. FIG. 4 illustrates a front view of clasp assembly 20, where pin 42 and deflection ridge 40 are disposed in the channel 44. The pin 42 is suspended between the sidewalls 22 and 24, while the deflection ridge 40 rises from the bottom portion 32 into the channel 44. FIG. 5 illustrates an isometric view of clasp assembly 20, showing channel 44, which extends from the front surface 26 through the back surface 28.

Figure 6:
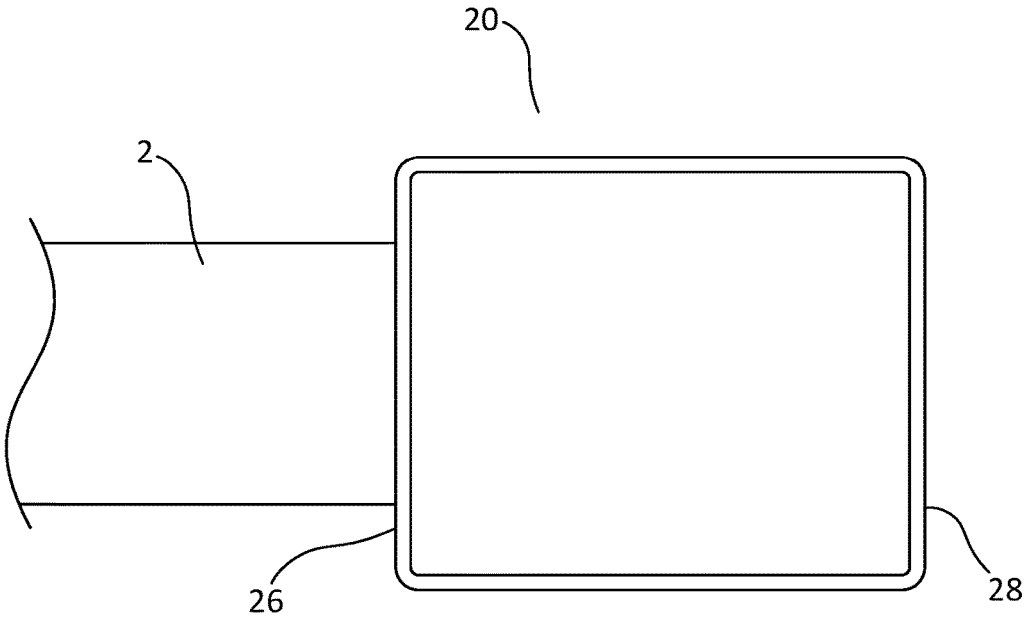
FIG. 6 illustrates a top of the clasp of FIGS. 1-5 including strap positioned therein.

FIG. 6 illustrates a strap 2 extending into the clasp assembly 20 through the front surface 26.

Figure 7:
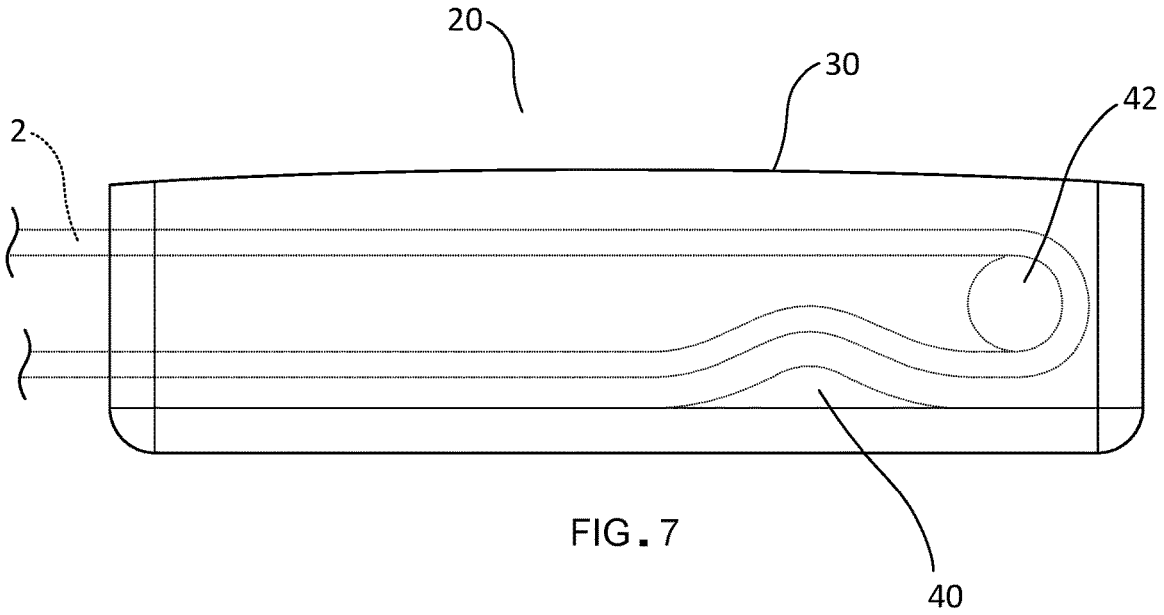
FIG. 7 illustrates a side view of the clasp showing a strap wrapping around an internal pin and over a deflection ridge therein.

FIG. 7 illustrates how the strap 2 is disposed within the channel 44 of clasp assembly 20 and in particular around pin 42 and over deflection ridge 40.

Figure 8:
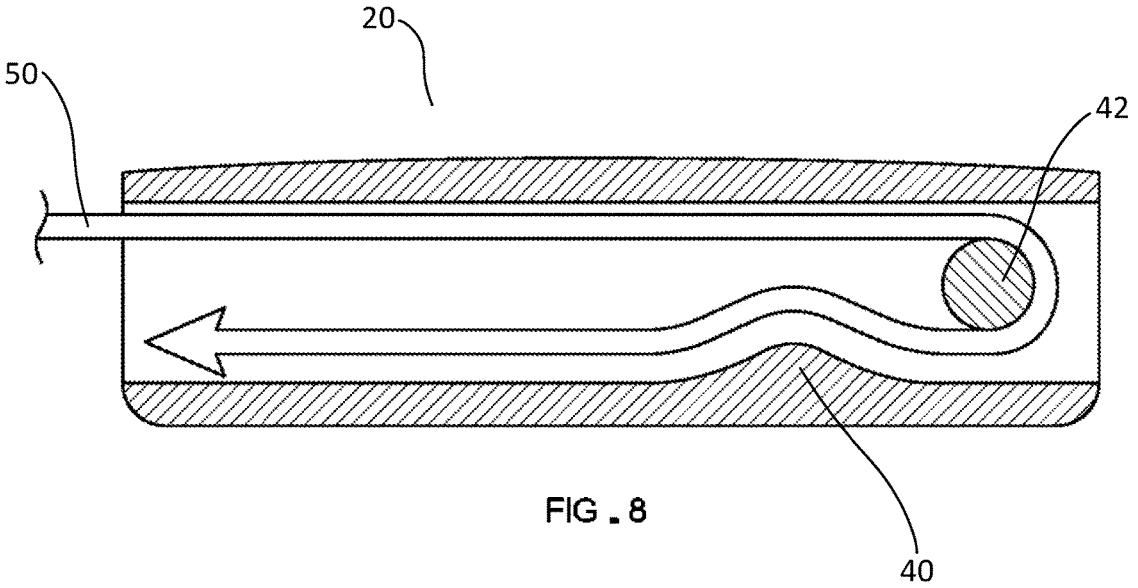
FIG. 8 is cross-sectional view showing the path of the strap through the clasp and including the deflection ridge.

FIG. 8 is a cross-sectional of clasp assembly 20, again illustrating the tortuous path 50 that strap 2 extends into channel 44, around pin 42 and over deflection ridge 40. It should be noted that the placement of pin 42 and deflection ridge 40 are intentional within channel 44. In particular, the deflection ridge is placed on the bottom of clasp assembly 20 while the pin 42 is positioned close to the middle of the channel height. As strap 2 wraps around pin 42 and comes back across deflection ridge 40 the bending causes a bit of interference. Furthermore, where the bottom 32 is often placed against the item, person, appendage, about which the magnetic clasp system is placed allows for the portion of the strap above the pin, when placed in tension, to provide a force on a portion of the strap under the pin and resting on the deflection ridge.

One formulaic ratio that can help determine the distance from the outer circumference of the pin to the outer surface of the deflection ridge is $f(x)=0.95t$ where t is strap thickness. This function is largely impacted by the general thickness of the strap as it needs to pass under the pin and over ridge with a certain amount of compression. That compression can be ~5%, 7%, 8%, 10% and so forth. A secondary calculation of the height of the ridge is governed by the suppleness of the strap material. In other words, the arrangement of the components of the clasp assembly are designed based on the thickness and suppleness of the strap to be used, which directly impact the height of the deflection ridge, size of the pin, and desired compression percentage.

This particular arrangement would not work as well, if the orientation were reversed. In fact, that is intentional to the design. As the clasp assembly 20 is formed of a magnetic material, when placed near the distal end of the strap 2 where an embedded magnet (or magnetic material) 6 is disposed therein, the bottom 30 of clasp assembly 20 is magnetically attached to the distal end over the embedded magnet 6. It should be understood that either clasp assembly 20 or magnet 6 could be formed of a magnet, magnetic material or portions thereof that are magnetic. Again, in this configuration when tension is placed on the strap, the arrangement of the strap through the clasp assembly prevents the strap from slipping while the magnetic force between clasp assembly 20 and magnet 6 keep the system together. Once the force is sufficient to overcome the magnetic force the clasp assembly 20 and magnet separate. When clasp assembly 20 is oriented with deflection ridge on top (upside down) the strap can be slid or adjusted through channel 44 easier as the orientation frees up the end of the strap for loosening. In other words, if the clasp assembly 20 were to be attached upside down to magnet 6, the forces on strap 2 within clasp assembly 20 would not be as prevalent and thus the system would not work as ideal. In fact, the strap may have force that loosens, which is less than the magnetic force keeping clasp assembly 20 and magnet 6 together, thus resulting in the strap 2 being freed from the channel 44 of clasp assembly 20.

Figure 9:
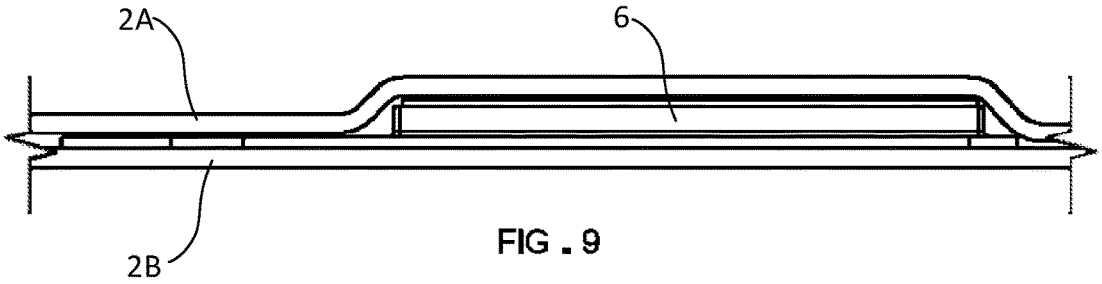
FIG. 9 is a cross-sectional view of an opposite end of the strap, which includes an embedded magnetic material therein.

FIG. 9 illustrates a cross sectional view of the embedded magnet 6 on the distal end of strap 2 as discussed above. The top portion 2A works with the bottom portion 2B of strap 2 to embed magnet 6 therein. As shown, the two portions can be sewn together, but other adhering or fix techniques can also be used. It should be noted, that magnet doesn't necessarily need to be fully embedded, but that a portion, such as the top surface could be exposed.

Figure 10:
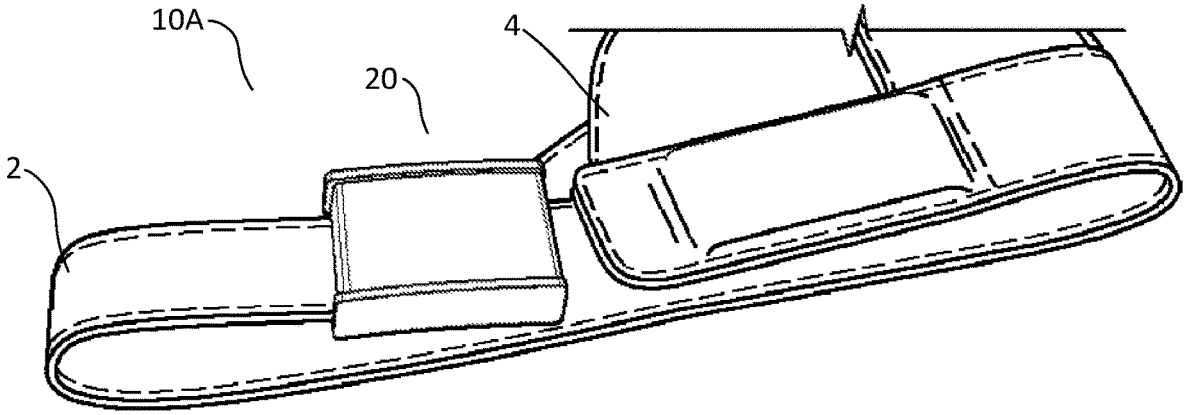
FIG. 10 illustrates a magnetic clasp system.

FIG. 10 illustrates the magnetic clasp system 10A in conjunction with a glove (that is only partially shown) where the magnetic clasp system 10A could be used with. This system could be used with belts, backpacks, gloves, purses, and incorporated into many other systems. It should be noted that the strap 2 does not necessarily need to form a complete loop as might be the case if the system were integrated with a bag or purse, which one of ordinary skill in the art would appreciate, but is commensurate with the scope of this application. In an application where adjustment to the length of the strap was not needed, the strap could be pre-measured cut and affixed back on to itself, via stitch, glue or some other increased compression.

The proceeding features and technical aspects have thus been described, but which also assist with the aesthetics, elegance and even ergonomics of the system. It should be noted that the top surface 30 has a curve to it, which is both pleasing to the eye and indicative of orientation, while the bottom surface 32 is flat and ideal for magnetically adhering. The sides, front and back surfaces have rounded corners and edges. The clasp assembly 20 is formed of a unitary design, which allows for ease with inserting a strap therein. There are no moving parts on this particular embodiment; however, that is not to say that pin 42 disposed in the channel could be affixed in either a fixed or rotating manner. The curve of deflection ridge 40 can be altered in multiple ways including have a more rounded top to a pointier ridge. The angle of the rise and fall of the ridge can also be modified.

The strap or belt can be formed of multiple types of materials including leather, cloth, fabric, or other compressible material. In theory a non-compressible strap could be used, but it would most likely defeat the elegance of the system.

A second embodiment of a magnetic clasp system 10B is illustrated in FIGS. 11-15. In this embodiment the magnetic clasp system 10B has a pull through tortuous path for the strap 2, as opposed to a path that wraps around a pin like in the embodiment above.

Once again, the magnetic clasp system 10B will be discussed herein primarily in the context of use with respect to glove closures but can be similarly applied to any number of clasping systems with regard to other strap systems such as; belts, bag closures, linear ropes, box closures, tarp connections, or virtually any other scenario in which an adjustable closure or affixation point is desired. It will be appreciated that when referring to a strap, that any similar tensile structures are contemplated within the use of such a term. It will be understood to those having skill in the art, and having possession of this disclosure, that the magnetic clasp system 10A and 10B are of particular advantage in situations requiring clasping utilizing only a single hand.

In particular the magnetic strap system 10B can include a clasping assembly 100 which can be provided at an infinitely adjustable location along the strap 2, a mounting assembly 200, which is provided at a fixed point along an opposing end of the strap, or at another connection point, such as along the side of a truck, opposing side of a bag, etc. and a stop assembly 300.

Figure 11:
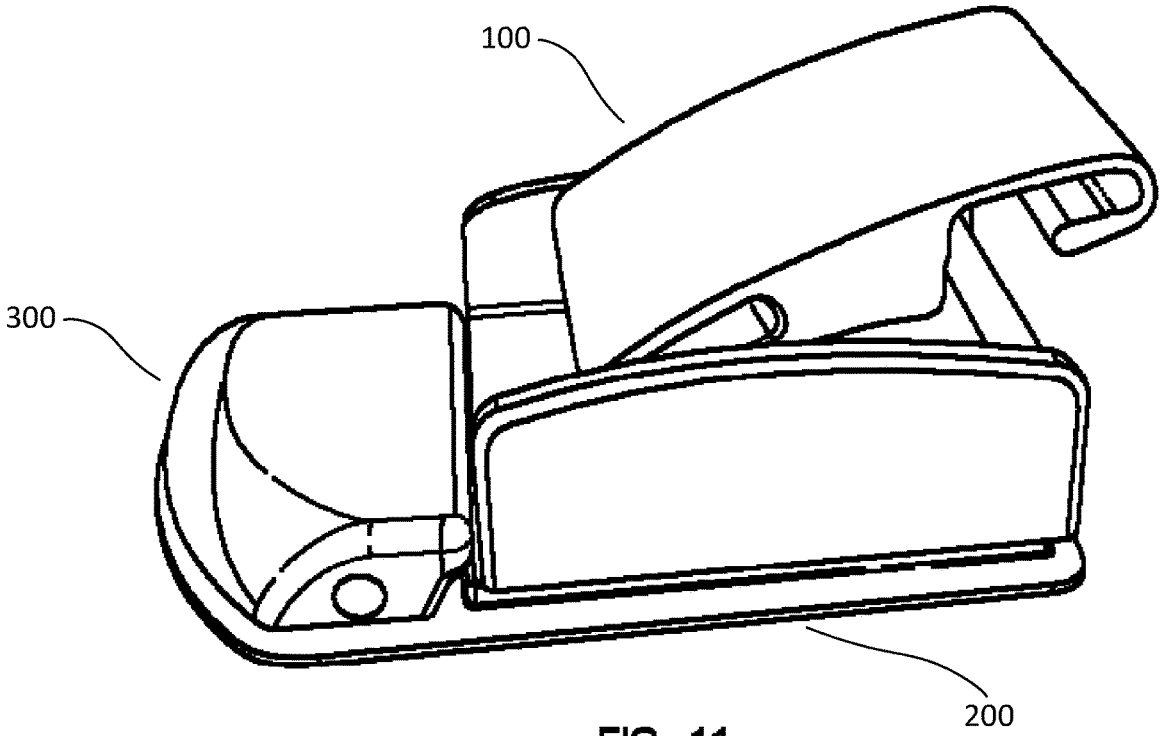
FIG. 11 is alternative clasp embodiment and stopping mechanism.

FIG. 11 illustrates a perspective view of a magnetic clasp system 10B in accordance with various aspects of the present invention sans strap 2. In particular, it illustrates the clasp assembly 100, mounting assembly 200 and stop assembly 300.

Figure 12:
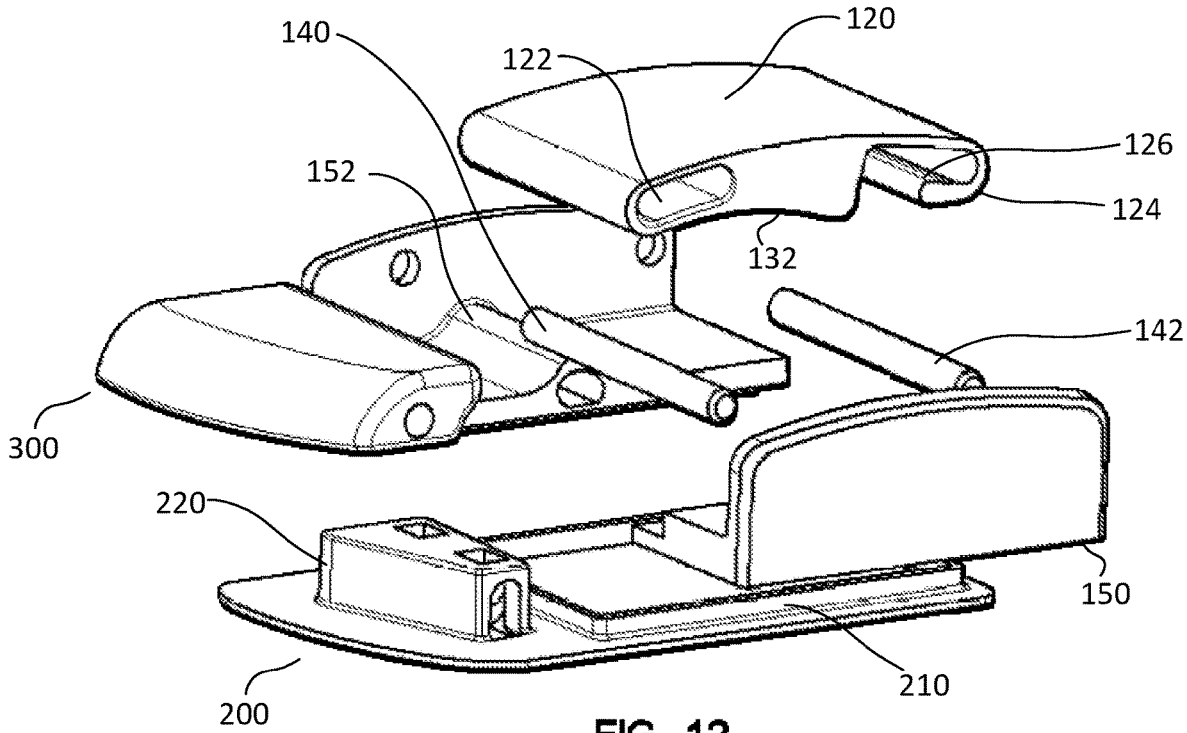
FIG. 12 is an exploded view of the alternative clasp embodiment and stopping mechanism of FIG. 11.

FIG. 12 illustrates an exploded view of the various components of FIG. 11. In particular, components associated with the clasp assembly include a hinged compression clasp 120, having a channel or slot 122, hook portion 124, optional hook protrusion 126, upper deflection ridge 128, recess portion 130, alignment blades 132, hinge pin 140, locking pin 142, base 150 that can be formed of two components for assembly or be unitary, having a bottom portion from which a base deflection ridge 152 is formed, and opposing sidewalls about which hinge pin 140 and locking pin 142 can be disposed between.

The slot or channel 122 of the hinge compression clasp 120 can be disposed about the hinge pin 140, so as to allow lateral motion as well as rotation about the hinge pin. The slot 122 is elongated and rounded to conform with the hinge pin 140. The hook portion 124 and optional hook protrusion 126 work to connect and snap into place about the locking pin 142.

The alignment blade(s) 132 can be provided about an edge portion of the recess 130. These alignment blades 132 can fit within the inner sidewalls of base 150 so as to ensure smooth operation of the hinge compression clasp 120. In some embodiments the alignment blades can extend further into the base and be received in a slot or recess, not shown, about the sidewalls of the base deflection ridge 152 so as to ensure proper alignment and smooth travel while translating. These alignment blades can be provided as a magnetic material or a magnetically responsive material so as to aide in the locking or retention force of the hinged compression clasp 120 within the base 150.

Also shown in FIG. 12 is the mounting assembly 200, which includes a recess 210 for mounting a magnet 6 or magnetic material therein. It also includes a mounting block 220, where the stop assembly can be mounted thereto.

Figure 13:
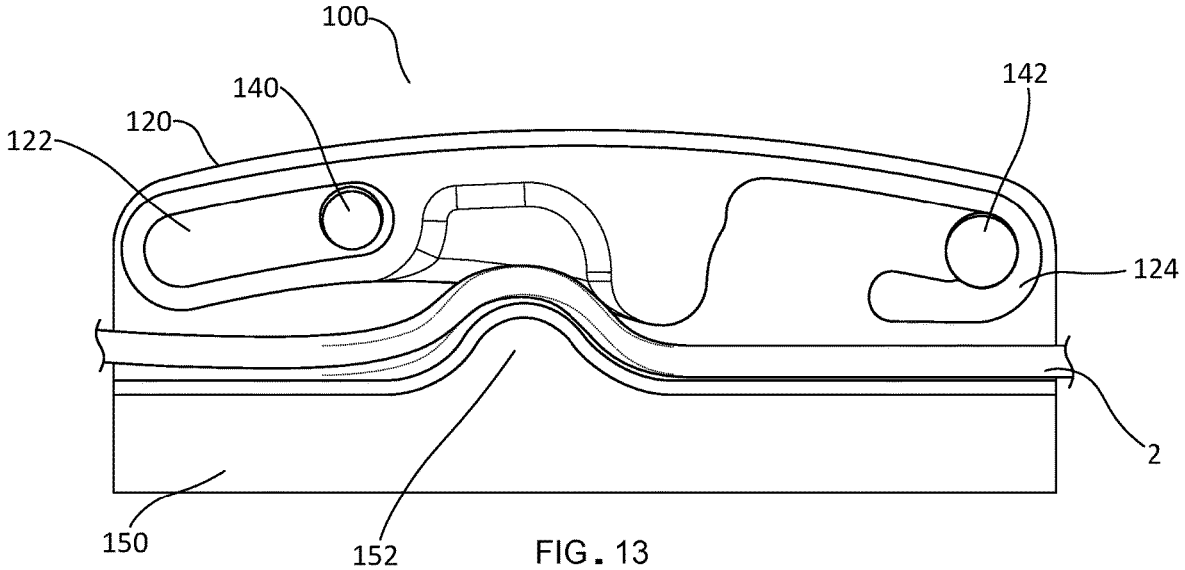
FIG. 13 is the cross-sectional front view of the alternative clasp embodiment of FIG. 11.

FIG. 13 illustrates a cross-sectional view of the clasp assembly 100 and the positioning of a strap 2 therein. In particular, the position of the hinge compression clasp 120 is shown in a closed configuration, as opposed to that shown in FIGS. 11-12. While in the closed configuration, the upper deflection ridge 128 is offset from that of the base deflection ridge 152, which form a tortuous path for the strap 2 to extend through. This closed state also places a compressive force onto the strap 2 such that lateral movement of the strap is deterred. This compressive force can cause some deformation of the strap 2, which helps provide the interference needed to prevent lateral movement in the closed state. A user can press upon the end of the hinge compression clasp 120 closest to the slot 122, which can slide laterally slide the hinge compression clasp 120 with respect to locking pin 142 and once free of the hook portion 124, the hook portion end of the hinge compression clasp pops open and rotates upwards and away from the strap 2. This open and closing operation can be done with one hand and can be done while the clasp assembly 100 is magnetically adhered to the mounting assembly 200 and abutted against the stop assembly 300.

Figure 14:
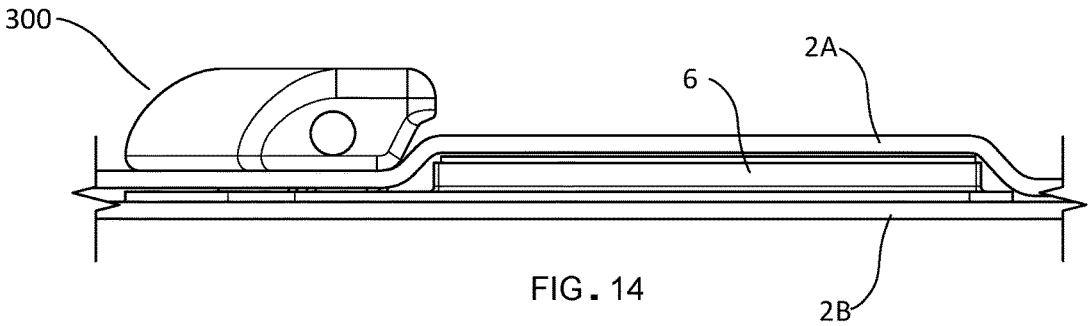
FIG. 14 is the one end of strap of the alternative embodiment having a magnetic material embedded therein with an adjacent stopping mechanism.

FIG. 14 illustrates a cross-sectional view of the magnet 6 disposed within the recess 210 of the mounting assembly 200 and embedded between the top and bottom portion 2A-B of strap 2. Similar to the first embodiment, the strap 2 can be sewn about or over the mounting assembly 200. It should be noted that the mounting block 200 can extend through an aperture or opening within the strap about which the stop assembly 300 can be disposed or mounted.

Stop assembly 300 can have a cantilevered portion 310 that extends towards and in some versions slightly over the magnet 6. The clasp assembly can be formed of a magnetic material, which allows for a magnetic adherence to the mounting assembly and prevent a certain amount of translational force, as well assist with alignment of the clasp assembly. The stop assembly 300 can deter additional translational motion in one direction, as tensional forces applied to the strap 2, which transfer through to the clasp assembly 100 may overcome the magnetic attraction or adherence between the clasp assembly 100 and the mounting assembly 200. In such circumstances the cantilevered protrusion can abut against a portion of the base 150 and provide for a mechanical or physical stop or impediment. In other words, the stop assembly 300 prevents sliding along one direction.

Figure 15:
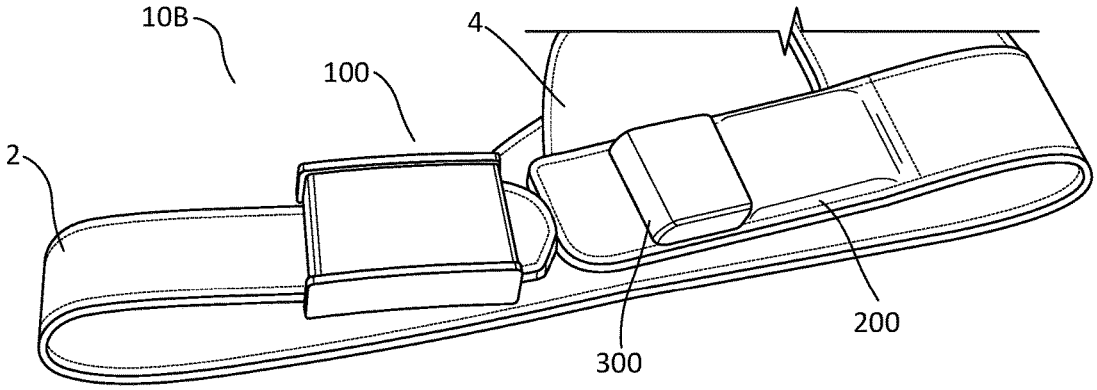
FIG. 15 illustrates an alternative magnetic clasp system.

FIG. 15 illustrates the magnetic clasp system 10B as incorporated with a glove 4.

It should be understood that the slot 122 and recess 130 should be provided with a sufficient lateral width so as to allow for proper translation of the hinged compression clasp 120 such that the hook portion 124 can engage around the locking pin 142 and interferingly engage therewith and be properly released when desired for readjustment along the strap.

In some embodiments the stop can be provided as replaceable and have various desirable cosmetic shapes. In some aspects of the present invention, a retention pin (not labeled) can be removable so as to allow for replacement of the stop assembly 300 with varying sizes, shapes, colors, materials, etc.

In some embodiments the mounting assembly 200 can be retained within the strap layers using an adhesive, or can merely be sandwiched, and rely on an interference fit when the edges of the strap are glued or sewn together.

While several embodiments have been described herein that are exemplary of the present invention, one skilled in the art will recognize additional embodiments within the spirit and scope of the invention. Modification and variation can be made to the disclosed embodiments without departing from the scope of the disclosure. Those skilled in the art will appreciate that the applications of the embodiments disclosed herein are varied, however, it will be further appreciated that any particular feature or combination can be applied in conjunction with any other feature or combination as appropriate. In this regard, it is intended that such changes would still fall within the scope of the disclosure. Therefore, this disclosure is not limited to particular embodiments, but is intended to cover modifications within the spirit and scope of the disclosure.

What is claimed is:

1. A magnetic clasp system, the magnetic clasp system comprising:

a first clasp component comprising a housing having an interior, the housing further comprising:

a top having a top exterior surface and a top interior surface;

a base having a base exterior surface and a base interior surface, wherein the base interior surface includes a ridge;

two sidewalls each having an exterior surface and an interior surface;

a first open end;

a second open end; and a pin located in the interior of the housing;

wherein the ridge is located between the first open end and the second open end and the pin is located between the ridge and the second open end, wherein the ridge and the pin define a tortuous path therebetween configured to receive a strap, and wherein the straps enters the housing at the first open end, loops around the top of the pin back towards the first open end, and the strap where it returns is press against the strap where it enters by the ridge, and wherein the base includes a magnetically responsive material; and a second clasp component, the second clasp component including a magnetically responsive material configured to draw the first clasp component and the second clasp component together when within a magnetic field thereof.

2. The magnetic clasp system of claim 1, wherein the ridge is located proximally nearer to the second open end than the first open end.

3. The magnetic clasp system of claim 1, wherein the pin is located proximally nearer to the top interior surface than the bottom interior surface.

4. The magnetic clasp system of claim 1, wherein the strap comprises at least one layer of material and the second clasp component is covered by a layer of the material.

5. The magnetic clasp system of claim 4, wherein the at least one layer of material is comprised of at least one of leather, cloth, fabric, or other compressible material.

6. The magnetic clasp system of claim 1, wherein the strap is configured to be pushed or pulled by a user to adjust the size of the strap.

7. The magnetic clasp system of claim 1, wherein the housing is a unitary element.

8. The magnetic clasp system of claim 1, wherein a height of the ridge is determined based on the thickness of a strap to be used, a suppleness of the strap, and a desired compression ratio of the strap with the magnetic clasp system.

* * * * *